US011110714B2

(12) United States Patent
Nielsen et al.

(10) Patent No.: US 11,110,714 B2
(45) Date of Patent: Sep. 7, 2021

(54) PRELOADED STORAGE CONTAINER AND PRINT HEAD TO DISPENSE FLUID

(71) Applicant: HEWLETT-PACKARD DEVELOPMENT COMPANY, L.P., Spring, TX (US)

(72) Inventors: Jeffrey A. Nielsen, Corvallis, OR (US); Michael W. Cumbie, Corvallis, OR (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 32 days.

(21) Appl. No.: 16/604,516

(22) PCT Filed: Aug. 28, 2017

(86) PCT No.: PCT/US2017/048856

§ 371 (c)(1),
(2) Date: Oct. 10, 2019

(87) PCT Pub. No.: WO2019/045675

PCT Pub. Date: Mar. 7, 2019

(65) Prior Publication Data

US 2020/0147972 A1 May 14, 2020

(51) Int. Cl.
*B41J 2/175* (2006.01)
*B41J 2/03* (2006.01)

(52) U.S. Cl.
CPC ..... *B41J 2/1752* (2013.01); *B41J 2/03* (2013.01)

(58) Field of Classification Search
CPC .. B41J 2/1752; B41J 2/03; B41J 2/175; B01L 2400/0439; B01L 2400/0442; B01L 2200/141; B01L 2200/143; B01L 2300/0645; B01L 3/0268
USPC ..... 347/85
See application file for complete search history.

(56) References Cited

U.S. PATENT DOCUMENTS

| | | | | |
|---|---|---|---|---|
| 8,506,908 | B2 | 8/2013 | Benn et al. | |
| 9,651,460 | B2 | 5/2017 | Albuquerque et al. | |
| 2002/0196317 | A1* | 12/2002 | Santhanam | B41J 2/17503 347/85 |
| 2003/0206220 | A1* | 11/2003 | Childers | B41J 2/17546 347/85 |
| 2006/0183216 | A1 | 8/2006 | Handique et al. | |

(Continued)

FOREIGN PATENT DOCUMENTS

| | | |
|---|---|---|
| WO | WO-2007026134 | 3/2007 |
| WO | WO-2009047501 A1 | 4/2009 |
| WO | WO-2014085412 A1 | 6/2014 |

OTHER PUBLICATIONS

Smith; "Blister Pouches for Effective Reagent Storage and Release for Low-cost Point-of-care Diagnostic Applications"; 2016.

*Primary Examiner* — Huan H Tran
*Assistant Examiner* — Alexander D Shenderov
(74) *Attorney, Agent, or Firm* — Fabian VanCott

(57) ABSTRACT

An apparatus includes a print head coupled to a substrate to dispense fluid from the substrate in response to a command. A reservoir coupled to the substrate transports the fluid to the print head. A preloaded storage container mounted on the reservoir stores the fluid and provides the fluid to the reservoir in response to pressure applied to the container.

20 Claims, 5 Drawing Sheets

(56) References Cited

U.S. PATENT DOCUMENTS

| | | | | |
|---|---|---|---|---|
| 2007/0139488 | A1* | 6/2007 | Fujishiro | B41J 2/17513 347/72 |
| 2012/0080315 | A1* | 4/2012 | Kennedy | G01N 27/44791 204/602 |
| 2012/0196304 | A1 | 8/2012 | Dees et al. | |

* cited by examiner

PRELOADED STORAGE CONTAINER AND PRINT HEAD TO DISPENSE FLUID

BACKGROUND

Micro-dispensing technologies produce liquid media dosages in volumes of less than one micro-liter. The continuing miniaturization of such technologies in almost all technical areas creates change and opportunity for industry, medical fields, development, and research facilities. Thus, ever-smaller amounts of adhesive, liquid, oil, and/or other fluid media has to be dispensed reliably and accurately with respect to dosage and placement of the media for subsequent dispensing. The precise positioning and quantity of fluids such as reagents or other substances dispensed influence the overall quality of a given micro-dispensing technology.

DETAILED DESCRIPTION

An apparatus enables precise dispensing of fluids while mitigating manual fluid-filling procedures to load the apparatus before dispensing. The apparatus includes a print head that can be coupled to a substrate to dispense fluid from the substrate in response to a command (e.g., dispense command issued to print head from a processor or controller). A reservoir (or reservoirs) can be mounted (or formed) on the substrate to transport the fluid to the print head. A preloaded storage container, mounted on the reservoir, stores the fluid and provides the fluid to the reservoir in response to pressure applied to the container. The apparatus including the print head can be discarded after dispensing of the fluid. By utilizing the preloaded storage container to load the print head via the reservoir(s), manual fluid-filling procedures can be avoided (e.g., manually filling reservoir via pipette dispenser). Moreover, the preloaded storage container separates the fluid from the print head until after pressure is applied to the container. In this manner, contamination and/or drying of the fluid at the print head can be mitigated until dispensing of the fluid is to commence.

The substrate can be a silicon substrate and the reservoir can be a polymer-based material such as an epoxy molding compound or an injection molding material for example. In some examples, the print head can be a thermal ink jet print head or a piezoelectric print head. The substrate can include a set of electrodes that controls the dispensing of the fluid from the substrate in response to the command, where the command can be issued from a processor or controller to cause the fluid to be dispensed from the print head. The set of electrodes can be connected to a detection circuit on the substrate or print head to detect that the reservoir has been filled with the fluid to facilitate that proper dispensing occurs. For instance, the detection circuit can include an impedance circuit to measure a change of impedance in the substrate or print head as the fluid reaches the substrate. A memory can be provided that is accessible via the set of electrodes, where the memory records a fluid type for the fluid that is stored in the preloaded storage container to verify that the desired fluid will be dispensed before the command is issued. The preloaded storage container can be a blister pack having a flexible membrane to store the fluid. The blister pack includes a cover to hold the fluid in the flexible membrane until pressure is applied to the pack to cause release of the stored fluid.

Figure 1:
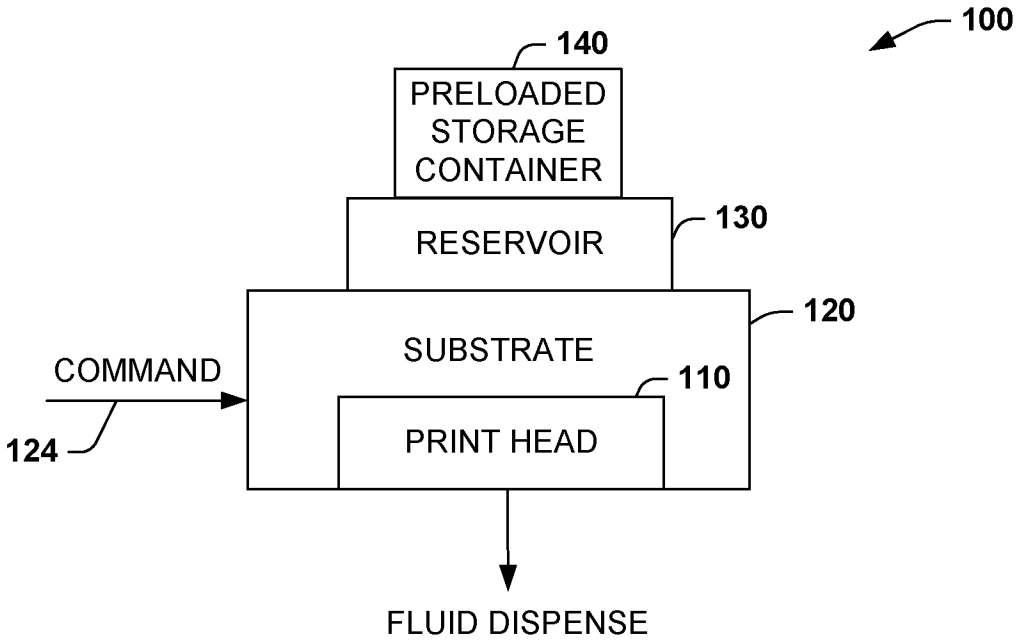
FIG. 1 illustrates an example apparatus to dispense a fluid.

FIG. 1 illustrates an example apparatus 100 to dispense a fluid. The apparatus 100 includes a print head 110 that is coupled to a substrate 120 to dispense fluid (e.g., biological fluid, reagent, antibiotic, pharmaceutical, industrial fluid, and so forth) from the substrate in response to a command 124 (e.g., dispense command issued to print head from a processor or controller). The print head 110 can be attached to the substrate 120 or formed as part of the substrate. A reservoir 130 (or reservoirs) can be mounted (or formed) on the substrate 120 (e.g., silicon substrate, printed circuit board substrate) to transport the fluid to the print head 110. A preloaded storage container 140, mounted on the reservoir 130, stores the fluid and provides the fluid to the reservoir in response to pressure applied to the container. The print head 110 can be a thermal ink jet (TIJ) print head in one example or a piezoelectric print head in another example. A plurality of reservoirs 130 can be mounted or formed on the substrate 120 (see e.g., FIG. 2). The plurality of reservoirs 130 can receive the fluid from the preloaded storage container 140 and transport the fluid to separate portions of the substrate 120 in response to the pressure applied to the preloaded storage container. In another example, a plurality of reservoirs 130 can be mounted or formed on the substrate 120 where each of the plurality of reservoirs receive separate fluid from separate preloaded storage containers 140 assigned to each reservoir.

The substrate 120 can include a set of electrodes (see e.g., FIGS. 2 and 3) that controls the dispensing of the fluid from the print head 110 in response to the command 124. In an example, the set of electrodes can be connected to a detection circuit on the substrate 120 or print head 110 to detect that the reservoir 130 has been filled with the fluid. For instance, the detection circuit can include an impedance circuit to measure a change of impedance in the substrate 120 or print head 110 as the fluid reaches the substrate and/or print head. The detection circuit can provide feedback to a processor (see e.g., FIG. 6) to indicate that the fluid has reached the substrate and/or print head before fluid dispensing begins. A memory can be provided on the substrate 120 that is accessible via the set of electrodes and records a fluid type for the fluid that is stored in the preloaded storage container 140. As used herein, the term fluid type refers to the chemical ingredients of the fluid to be dispensed (e.g., reagent type, antibiotic type, pharmaceutical type, industrial solvent type, and so forth). The memory can also serve as feedback to the processor to facilitate that the desired fluid type is dispensed via the print head 110. The preloaded storage container 140 can be a blister pack, for example, having a flexible membrane to store the fluid. The blister pack includes a cover to hold the fluid in the flexible membrane until pressure is applied to the pack to release the stored fluid.

The fluids described herein can be of various solutions such as based on dispensing solvent-based pharmaceutical compounds and aqueous-based biomolecules including proteins, enzymes, lipids, antibiotics, mastermix, and DNA samples, for example. The apparatus 100 can support various applications that include antimicrobial susceptibility testing, compound secondary screening, enzyme profiling, and polymerase chain reaction (PCR) dispensing, for example. The apparatus 100 can repeatability dispense small (e.g., picoliter) volumes of fluid in a rapid manner to perform many categories of dispensing such as direct dilution, for example. Direct dilution enables low dispense volumes from the print head 110 and provides the ability to titrate solutions across many orders of magnitude of concentration without serial dilution. Thus, the print head 110 can directly titrate by dispensing single drops to achieve low concentrations along with dispensing many fluid drops to achieve higher concentrations.

Other dispensing applications can include drug interaction, where the non-contact nature of print head 110 enables two or more fluids to be precisely jetted into a single well or target location. This enables multi-level synergy experiments for multiple dimethyl sulfoxide (DMSO)-based compounds, and/or enzyme profiling experiments of DMSO-based inhibitors and aqueous-based enzymes, antibiotics, or substrates, for example. Other dispensing applications include assay miniaturization, where the low dispense volume of the print head 110 enables the miniaturization of many different assays, including the dispensing of PCR-assay components, including master mix, and primer, for example. While previous dispensing systems utilize dry reservoirs that the end-user was expected to fill via pipette or other manual filling procedure, the apparatus 100 can preload fluids via integrated blister packs as the preloaded storage container 140 in one example. The container 140 can then be burst before use (e.g., based on applied pressure), thus, removing a high-skill step (pipetting) from the workflow and thus, reducing potential errors and waste associated with manual pipetting.

Figure 2:
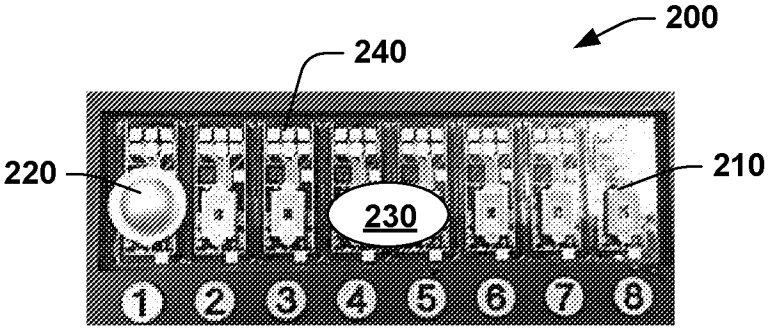
FIG. 2 illustrates an example print head having multiple reservoirs and a preloaded storage container to dispense a fluid.

FIG. 2 illustrates an example print head 200 having multiple reservoirs and a preloaded storage container to dispense a fluid. The print head 200 includes multiple reservoirs such as the example reservoir 210. Although eight reservoirs are shown for dispensing from eight different locations of a substrate, more or less than eight reservoirs can be provided. In one example, a single blister pack 220 is provided to cover one reservoir area. When pressure is applied to the blister pack 220, its contents can empty into the respective reservoir. In another example, a single blister pack 230 may provide fluid for two or more reservoirs. As shown, one or more sets of electrodes can be provided at 240. As described previously, the electrodes 240 can be utilized to receive a command to dispense a given fluid at a given location associated with the respective electrodes. The electrodes 240 can also be utilized to provide feedback such as whether a given reservoir has been filled and fluid has reached the substrate (e.g., via detection circuit fabricated on the substrate or print head). The electrodes 240 can also provide other types of feedback such as from a memory on the substrate that indicates the type of fluid to be dispensed from a given reservoir and storage container, for example.

Figure 3:
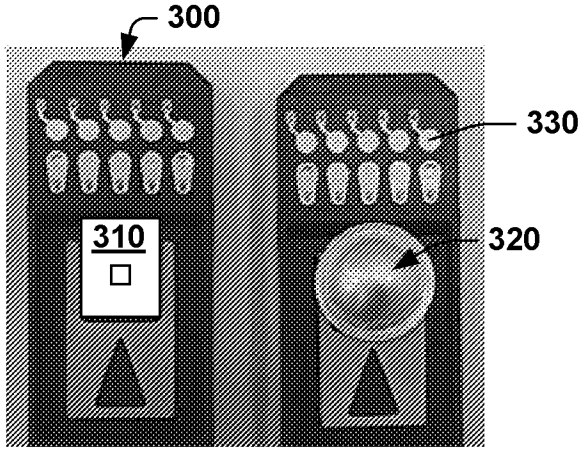
FIG. 3 illustrates an example print head having a single reservoir in which a preloaded storage container can dispense a fluid.

FIG. 3 illustrates an example print head 300 having a single reservoir 310 in which a preloaded storage container can dispense a fluid. The print head 300 shows the reservoir before a preloaded storage container has been mounted on top of the reservoir such as shown at 320. As shown at 330, one or more sets of electrodes can be provided to receive a dispense command from a processor and/or to provide feedback to the processor via the electrodes (see e.g., system of FIG. 6).

Figure 4:
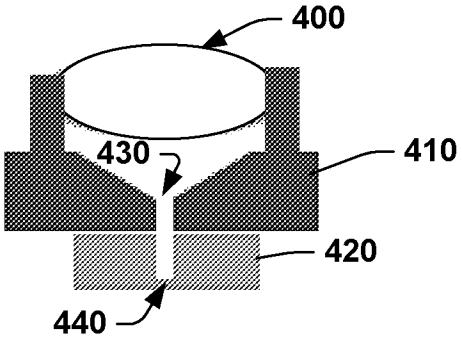
FIG. 4 illustrates a side-view of a preloaded storage container and reservoir that provide dispensing fluid to a substrate.

FIG. 4 illustrates a side-view of a preloaded storage container 400 and substrate 410 having a reservoir formed therein that provide dispensing fluid to a print head 420. In this example, the reservoir formed in the substrate 410 can include a channel 430 that feeds a dispenser opening 440 into the print head 420. Along the opening 430 or 440, a detection circuit can be embedded within the substrate 410 or print head 420 to detect whether fluid has reached the substrate 410 and/or print head 420. For example, the detection circuit can include parallel circuit connections along the opening 444 that measure a change in impedance of the substrate 410 or print head 420 when wetted via a respective fluid. The reservoir formed in the substrate 410 can be an epoxy molding compound in one example or an injected molded plastic in another example.

Figure 5:
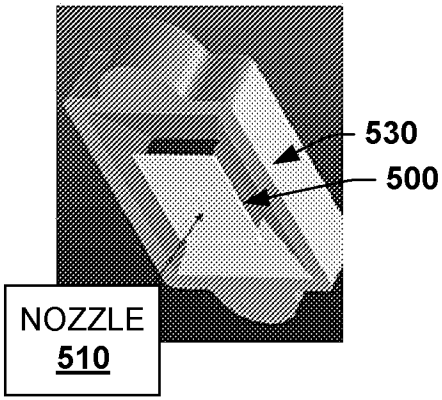
FIG. 5 illustrates a bottom-view of a print head having a nozzle, where the print head is coupled to a reservoir to receive fluid.

FIG. 5 illustrates a bottom-view of a print head 500 having a nozzle 510, where the print head is coupled to a substrate 530 having a reservoir formed therein to receive fluid. In this example, a single nozzle is shown at 510 but in other examples, multiple nozzles can be fabricated which receive fluid from a given substrate 530. Such nozzles can be associated with a thermal ink jet print head in one example but other nozzle types are possible to dispense fluid as described herein.

Figure 6:
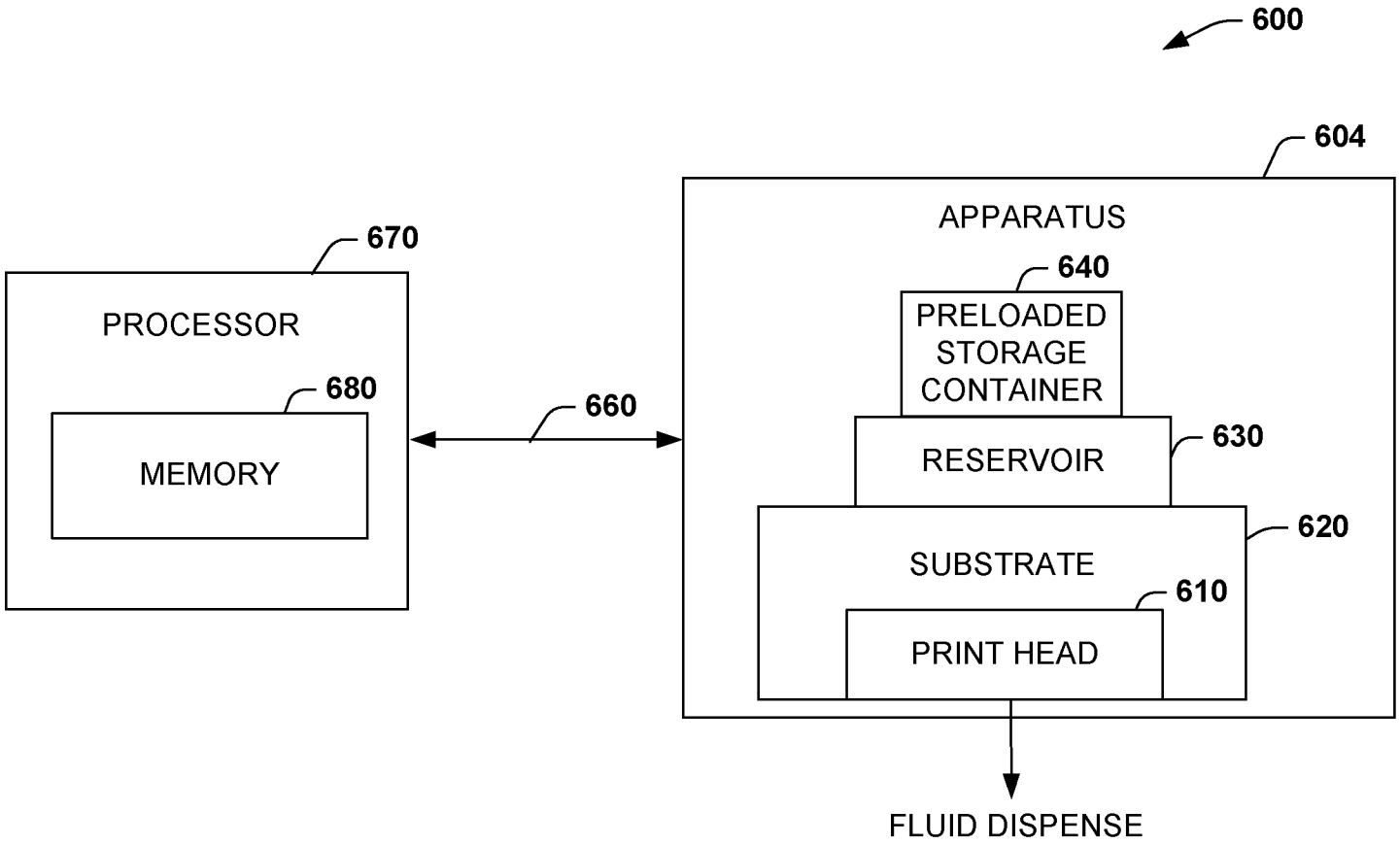
FIG. 6 illustrates an example system to dispense a fluid.

FIG. 6 illustrates an example system 600 to dispense a fluid. The system 600 includes an apparatus 604 having a print head 610 coupled to a substrate 620 to dispense fluid from the substrate in response to a command. A reservoir 630 coupled to the substrate 620 transports the fluid to the print head 110. A preloaded storage container 640 mounted on the reservoir 630 stores the fluid and separates the fluid from the print head 610 until pressure is applied to the container. A processor 670 includes a memory 680 that stores machine-executable instructions. The instructions cause the processor 670 to issue the command at 660 to dispense the fluid.

The substrate 620 can include a set of electrodes that controls the dispensing of fluid from the print head 610 in response to the command issued at 660 by the processor 670. The set of electrodes can be connected to a detection circuit on the substrate 620 or print head 610 to detect that the substrate and/or print head has received the fluid from the reservoir 630. The detection circuit can include an impedance circuit to measure a change of impedance in the substrate 620 or print head 610 as the fluid reaches the substrate. The detection circuit can provide feedback to the processor 670 via connection 660 to indicate that the fluid has reached the substrate 620 or print head 610 before fluid dispensing begins. A memory (not shown) can be provided (e.g., formed in the substrate) that is accessible via the set of electrodes that records a fluid type for the fluid that is stored in the preloaded storage container 640. The memory can also serve as feedback to the processor 670 via the set of electrodes to facilitate that the desired fluid type will be dispensed.

The system 600 can include one or more blister-pack reservoirs integrated into a fluidic molded interconnect apparatus. Preloaded reagent reservoirs 630 can be provided in several example configurations. In one example, blister film layers can be integrated into a molded reservoir (e.g., epoxy molding compound (EMC) or injection molded plastic). In one example configuration, a single blister reservoir 630 can feed multiple print/dispense heads 610 via routing through an EMC layer or other type material layer. The print head 610 and/or substrate 620 can include an integrated prime detection circuit (e.g., impedance circuit) to provide closed-look feedback that the fluid reservoir 630 has been filled.

Figure 7:
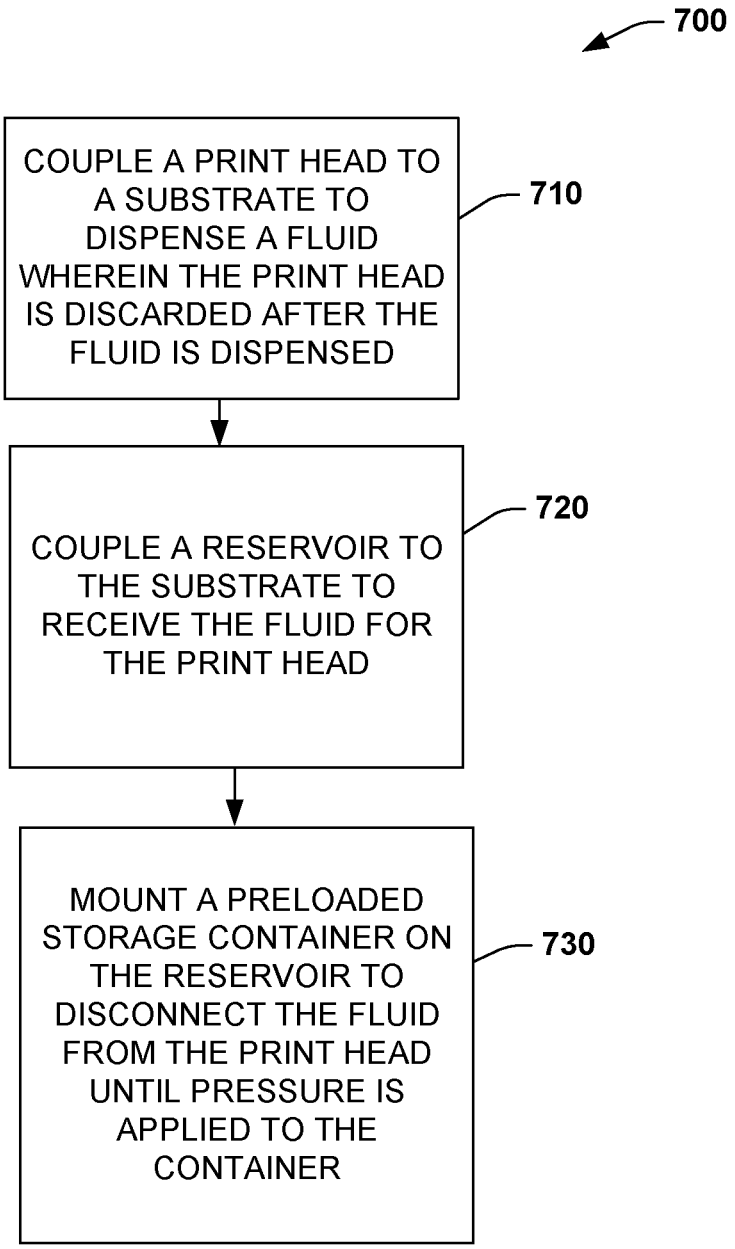
FIG. 7 illustrates an example method to dispense a fluid.

In view of the foregoing structural and functional features described above, an example method will be better appreciated with reference to FIG. 7. While, for purposes of simplicity of explanation, the method is shown and described as executing serially, it is to be understood and appreciated that the method is not limited by the illustrated order, as parts of the method could occur in different orders and/or concurrently from that shown and described herein. Such method can be executed by various components configured as machine-readable instructions stored in memory and executable in an integrated circuit or a processor, for example.

FIG. 7 illustrates an example method 700 to dispense a fluid. At 710, the method 700 includes coupling a print head to a substrate to dispense a fluid wherein the print head is discarded after the fluid is dispensed (e.g., print head 110 and substrate 120 of FIG. 1). At 720, the method 700 includes coupling a reservoir to the substrate to receive the fluid for the print head (e.g., reservoir 130 of FIG. 1). At 730, the method can include mounting a preloaded storage container on the reservoir to disconnect the fluid from the print head until pressure is applied to the container (e.g., via preloaded container 140 of FIG. 1).

Although not shown, the method 700 can also include forming a set of electrodes on the substrate to detect that the fluid has been transported to the substrate or the print head. This can include providing a circuit on the substrate or the print head to measure a change of impedance in the substrate as the fluid reaches the substrate or the print head. The method can also include forming a memory on the substrate that records a fluid type for the fluid that is stored in the preloaded storage container.

What have been described above are examples. One of ordinary skill in the art will recognize that many further combinations and permutations are possible. Accordingly, this disclosure is intended to embrace all such alterations, modifications, and variations that fall within the scope of this application, including the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. An apparatus, comprising:

a print head coupled to a substrate to dispense fluid from the substrate in response to a command;

a reservoir coupled to the substrate to transport the fluid to the print head; and a preloaded storage container mounted on the reservoir to store the fluid and to provide the fluid to the reservoir in response to pressure applied to the container sufficient to burst the container thereby releasing the stored fluid into the reservoir.

2. The apparatus of claim 1, wherein the print head is a thermal ink jet print head or a piezoelectric print head.

3. The apparatus of claim 1, further comprising a plurality of reservoirs coupled to the substrate, wherein the plurality of reservoirs receive the fluid from the preloaded storage container and transport the fluid to separate portions of the substrate in response to the pressure applied to the preloaded storage container.

4. The apparatus of claim 1, further comprising a plurality of reservoirs coupled to the substrate, wherein each of the plurality of reservoirs receive separate fluid from separate preloaded storage containers assigned to each reservoir.

5. The apparatus of claim 1, wherein the substrate includes a set of electrodes that controls the dispensing of the fluid from the substrate in response to the command.

6. The apparatus of claim 5, wherein the set of electrodes are connected to a detection circuit on the substrate or the print head to detect that the reservoir has been filled with the fluid.

7. The apparatus of claim 6, wherein the detection circuit includes an impedance circuit to measure a change of impedance in the substrate or the print head as the fluid reaches the substrate or the print head.

8. The apparatus of claim 5, further comprising a memory that is accessible via the set of electrodes that records a fluid type for the fluid that is stored in the preloaded storage container.

9. The apparatus of claim 1, wherein the preloaded storage container is a blister pack having a flexible membrane to store the fluid, the blister pack includes a cover to hold the fluid in the flexible membrane until pressure is applied to burst the cover.

10. The apparatus of claim 1, wherein the reservoir is attached to the substrate or formed as part of the substrate.

11. The apparatus of claim 1, wherein the fluid stored in the preloaded storage container being a biological or pharmaceutical fluid.

12. A method, comprising:

coupling a print head to a substrate to dispense a fluid wherein the print head is discarded after the fluid is dispensed;

coupling a reservoir to the substrate to receive the fluid for the print head;

mounting a preloaded storage container on the reservoir to disconnect the fluid from the print head until pressure is applied to the container; and forming a set of electrodes on the substrate to detect that the fluid has been transported to the substrate or the print head.

13. The apparatus of claim 12, further comprising providing a circuit on the substrate or the print head to measure a change of impedance in the substrate as the fluid reaches the substrate.

14. The method of claim 12, further comprising applying pressure to cause the preloaded storage container to burst to release the fluid to the reservoir.

15. The method of claim 12, further comprising performing titration with the print head by dispensing a number of drops of fluid to a number of wells to achieve specific concentrations in respective wells.

16. A system, comprising:

a print head coupled to a substrate to dispense fluid from the substrate in response to a command;

a reservoir coupled to the substrate to transport the fluid to the print head; and a preloaded storage container mounted on the reservoir to store the fluid and to separate the fluid from the print head until pressure is applied to the container, the fluid stored in the preloaded storage container being a biological or pharmaceutical fluid; and a processor having a memory to store machine-executable instructions that cause the processor to issue the command to the print head to dispense the fluid.

17. The system of claim 16, wherein the substrate includes a set of electrodes that controls the dispensing of the fluid from the substrate in response to the command issued by the processor, the set of electrodes are connected to a detection circuit on the substrate or the print head to detect that the substrate or the print head has received the fluid from the reservoir.

18. The system of claim 17, further comprising a memory accessible via the set of electrodes, wherein the memory records a type of the fluid that is stored in the preloaded storage container.

19. The system of claim 16, wherein the preloaded storage container releases the fluid to the reservoir in response to sufficient pressure to cause the storage container to burst.

20. The system of claim 19, wherein the preloaded storage container is a blister pack having a flexible membrane to store the fluid, the blister pack includes a cover to hold the fluid in the flexible membrane until pressure is applied to burst the cover.

* * * * *